US005224996A

United States Patent [19]

Ghys et al.

[11] Patent Number: 5,224,996

[45] Date of Patent: Jul. 6, 1993

[54] CURTAIN COATER

[75] Inventors: Jan J. Ghys, Bouwel; Willem Muës, Tremelo; Hendrik J. Geerts, Hulshout, all of Belgium

[73] Assignee: AGFA-GEVAERT N. V., Mortsel, Belgium

[21] Appl. No.: 800,076

[22] Filed: Nov. 29, 1991

[30] Foreign Application Priority Data

Dec. 12, 1990 [EP] European Pat. Off. ..... 90203269.7

[51] Int. Cl.[5] ..... B05C 5/00

[52] U.S. Cl. ..... 118/325; 118/DIG. 4

[58] Field of Search ..... 118/324.5, DIG. 4; 427/420

[56] References Cited

U.S. PATENT DOCUMENTS 3,632,374 1/1972 Greiller ..... 118/324

*Primary Examiner*—W. Gary Jones
*Assistant Examiner*—Charles K. Friedman
*Attorney, Agent, or Firm*—William J. Daniel

[57] ABSTRACT

A curtain coater for applying a layer or film of a liquid coating composition as a falling curtain on a surface of a continuous web moving around an arc of a backing roller, has a curved air shield arranged in closely spaced parallel relation to the roller periphery extending around a segment of said periphery directly upstream of the falling curtain to define an air gap through which the web passes before reaching said curtain. At the opposite end regions of the air shield and also at opposite side regions thereof are provided means, such as projections or sections of increased thickness, for increasing the resistance to air flow in the gap at the end and side regions compared to the air flow resistance in the region of the shield intermediate the end and side regions. A suction device communicates with the gap in the intermediate region to reduce the air pressure therein. The effect of this air shield is improved removal of the boundary layer of air at the surface of the moving web prior to the coating curtain and thereby allow increased speed of the moving web.

10 Claims, 3 Drawing Sheets

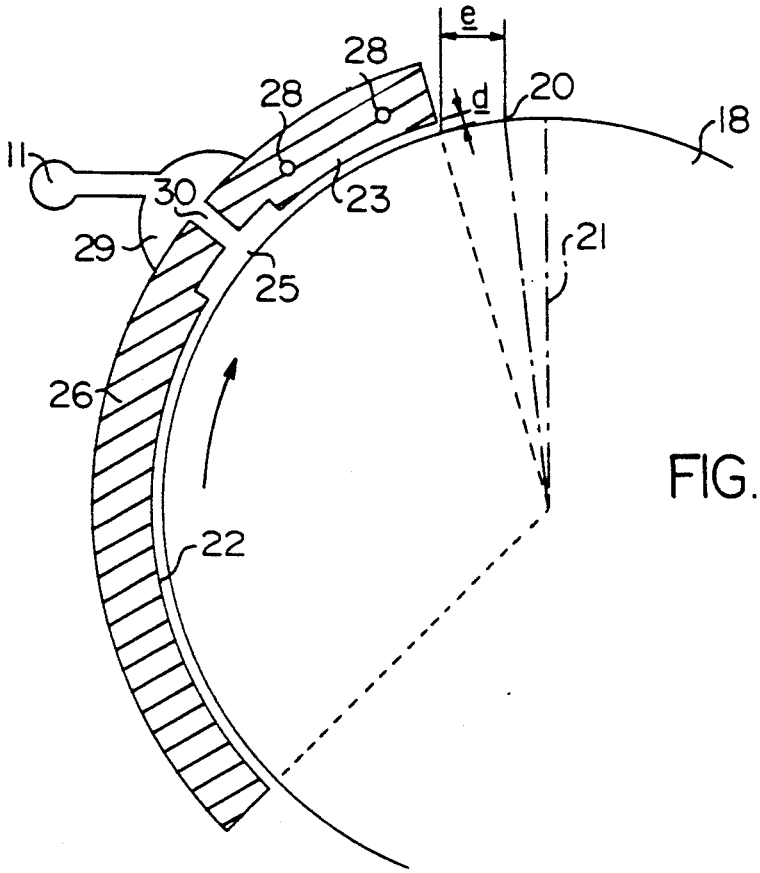
FIG. 2
FIG. 3
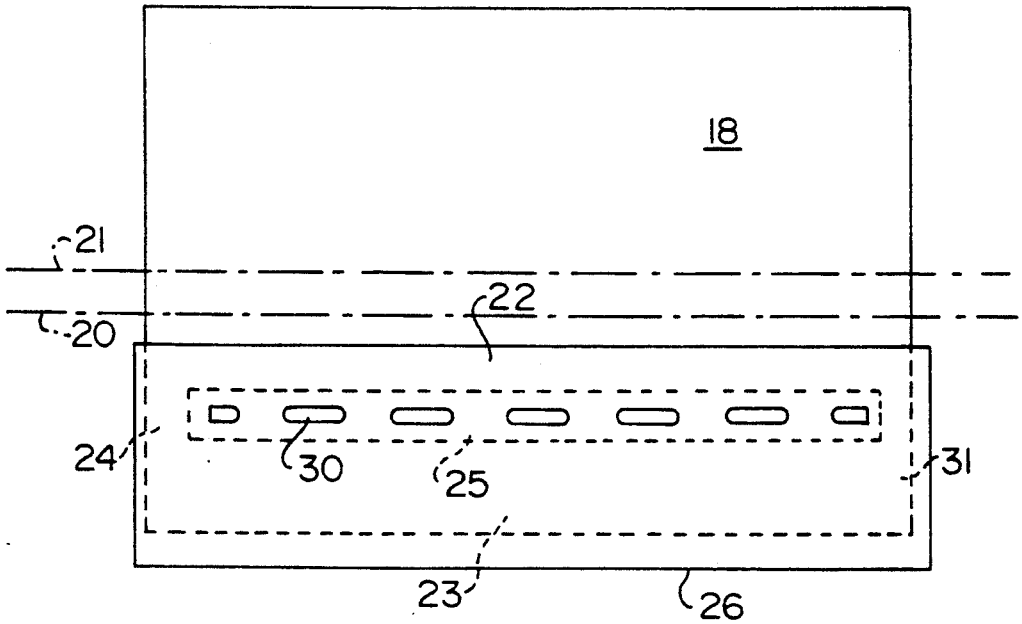

CURTAIN COATER

BACKGROUND OF THE INVENTION

1. Field of the invention

The present invention relates to a curtain coater for coating a layer of liquid coating composition on a continuous web in the manufacture of a photographic element.

2. Description of the prior art

In the manufacture of a coated photographic element, the coating compositions typically consist of aqueous solutions or dispersions containing hydrophilic colloids with or without other materials dissolved or dispersed therein. They are liquid compositions of relatively low viscosity, for example, of less than about 150 cP (centipoise), most in the range from about 5 to about 100 cP. After having been coated onto the surface of a support they are subjected to controlled temperatures to effect setting and drying. In the photographic art coating compositions are used which differ very much in chemical composition and, to a more limited extent, in physical characteristics. Various materials are used as the support. Thus, for example, the support is made of paper, film base, glass, cloth and the like, and it may be coated in the form of discrete sheets or, as is more usual, in the form of a continuous web.

The manufacture of photographic elements is a tremendously difficult art requiring extremely accurate control. Unlike coating operations in other arts, where complete coverage of the article being coated and attractive appearance are usually the only essentials for any particular coating method, in the photographic art the coating method must provide for precise control. A photographic element requires coating of individual layers which are extremely thin, i.e. a maximum wet thickness of about 150 micrometers, and generally far below this value, e.g. as low as about 10 micrometer. After coating the layers have to be set and/or dried before the product can be handled and their surfaces generally cannot be subjected to any physical treatment to increase their smoothness and/or their thickness uniformity. For this reason, the coating composition must be applied to the support in such a precise manner that after the layer is set and/or dried it will be within permissible tolerances with respect to both thickness and uniformity. Since an individual layer must be extremely thin, as is indicated above, and since the maximum variation in thickness uniformity is mostly plus or minus a few percent, it is obvious that the coating operation in the manufacture of photographic elements is an unusually complex and demanding procedure. Moreover, the difficulties involved in meeting the requirements of utmost thinness and extreme uniformity are magnified by the fact that in order to be commercially practical, the coating operation must be capable of handling continuous webs with a width up to one meter or more and must enable the web to be coated at high speeds, for example, speeds as high as several meters per second.

A particularly useful coater for realizing the objects set forth hereinbefore is a curtain coater. If such apparatus is arranged to provide exact control of the means by which the free-falling curtain is generated, and of certain critical relationships between the operating variables, high quality photographic elements may be produced with this type of coater. Basic patents on the use of a certain coater for the production of photographic elements are U.S. Pat. No. 3,632,374 and U.S. Pat. No. 3,508,947 relating to a single-layer and to a multiple-layer curtain coater respectively.

A phenomenon observed at coating speeds higher than approximately 150 $m.min^{-1}$ is the displacement of the curtain in the direction of the web movement by the air entrained by the web. A small layer of air that sticks to the moving web hits the contact line between curtain and web. Moreover the displacement of this contact line is not uniform since the curtain assumes a wavelike or undulating deformation, when viewed laterally of the curtain. As a consequence of the curtain deformation, the coated layer exhibits longitudinal bandlike thickness deviations. These bandlike deformations are of the order of magnitude of a few percent only, and are mostly not disturbing in the case of opaque photographic materials that are viewed or used in reflection. In the case, however, of photographic materials that are viewed in transmission or projection, the density variations caused by bandlike thickness variations in one or more of its light-absorbing layers, whether these layers are light-sensitive or not, are unacceptable.

In order to avoid this problem, one has to remove the boundary layer of air from the surface of the web. It has been proposed to obviate the problem is question by means of different techniques.

First, it is known to provide the coater with shield means that extend parallel with the curtain and terminate in close proximity of the web surface, with an end portion deflected in countercurrent direction relative to web movement. The shield means may occasionally be provided with a vacuum manifold operatively connected thereto for evacuating air from the surface of the web. The described improvement is disclosed in U.S. Pat. No. 3,867,901. We have noticed that at speeds over 150 to 200 $m.min^{-1}$, depending on the thickness of the applied layer, this kind of shield means does not prevent the formation of bands in the coated layer.

Another arrangement for removing the boundary layer of air from a web in a curtain coater is disclosed in FR-A 1,463,674. In this patent specification, which does not explicitly relate to the manufacture of photographical elements, a coater is described in which a web (such as cardboard or cellulose derivatives) is transported through a coating curtain by means of a conveyor roller before and after the curtain, and in which the web is deflected slightly downwards by contact with a knife edge that forms an air-tight joint between the knife and the web at a certain distance upstream of the curtain. According to an alternative embodiment of the arrangement, the knife is hollow and has an open edge at its underside, whereby the entrained air may be sucked off. Although the knife effectively removes the boundary layer of air from the web and also stabilizes the curtain as well as the web, its use is excluded in the manufacture of photographic elements since the frictional contact with the support inevitably damages the surface of the support. Damaging of a delicate web also occurs by particles of dust and the like that become collected at the front side of the knife and that cause scratching of the web surface.

Positioning this knife above the web as in FIG. 9 of U.S. Pat. No. 3,632,374 to avoid any contact, requires the use of large flowrates of sucked-off air in order to remove the boundary layer sufficiently. However, it is practically impossible to get uniform evacuation, across the width of the web of the boundary layer when flowrates of this order of magnitude are used. Any non-uniformity causes bandlike disturbances in the coated layer.

A still further arrangement for removing a boundary layer of air from a web comprises a concave shielding plate that is curved concentrically about the axis of a web-supporting roller and spaced from the roller periphery a distance not larger than about 1 mm. The narrow gap that is formed between the air shield and the web on the roller forms an important resistance to air entrained with the web, and thereby allows the use of higher coating speeds. The mentioned arrangement is disclosed in Research Disclosure No. 18916 of January 1980, but also with this arrangement a practical upper limit of the coating speed is approximately 200 $m.min^{-1}$ for a shield spacing of 1 mm. Due to constructive limitations smaller shield spacings can be used only for smaller curtain widths, such as curtain widths smaller than about 40 cm.

Finally, in DE-B-1,269,546 is disclosed a curtain coater in which individual objects to be coated are transported through a coating zone by means of two endless belts. Disturbing influences of air displacements in the coating room and of air entrained by the objects are reduced by brushes that bear on the end of a straight advancing stretch of the first belt. The effect of the described measure is also limited and in fact is advantageous only for the types of coating that are disclosed in the cited document, namely paints and adhesives.

It is clear that brushes with bristles or hairs that are stiff and/or sharp-ended are not suited for use in manufacturing of photographic material. It is even possible that the brush catches and gathers dust particles, and finally that large agglomerates of such particles drop free of the bristles and slip under the brush. Such agglomerates then become wound between successive convolutions of the roll of web and cause a permanent defect in the web surface. Positioning the brush above the web without making contact is an embodiment which avoids the problem of gathering the dust particles but at the price of unsatisfactory removal of the boundary layer.

SUMMARY OF THE INVENTION

Objects of the invention

It is an object of the present invention to provide an improved curtain coater that allows the application of thin layers at elevated speeds by means of curtain coating in the manufacturing of photographic elements. It is a further object to provide such a curtain coater that is simple of construction and easily to adjust and to maintain. Other objects will become apparent from the description hereinafter.

Statement of the invention

According to the present invention, a curtain coater for coating a layer of liquid photographic coating composition on a continuous web in the manufacture of a photographic element, comprises a coating hopper for producing a free-falling curtain of coating composition, a backing roller for guiding said web along a circularly curved path underneath said hopper, an air shield that is curved about an angular portion of the backing roller, said air shield having means at least near the inlet and outlet end of the shield, said means determining zones wherein the resistance to air flow is larger than in a zone located between such means, and means for reducing the air pressure in the zone which is located between said zones of larger air resistance.

The effect of this air shield is to remove the boundary layer of air from the web to an extent that is satisfactory to allow higher coating speeds than before. In order to suck off the entrained air uniformly, a stable, i.e. in time and place, reduced pressure is required. To obtain a reduced pressure with these qualities a high resistance to air flow must be built up between the zone which is to maintained at a lower pressure and the surrounding atmosphere. For this reason the means foaming an air barrier has to be placed close to the support, at a distance d smaller than 2 mm. It is obvious that for constructive reasons there is a limit in reducing this distance d. For coaters which can handle widths up to one meter or more this limit is about 0.5 mm.

The term "web" as used in the statement of invention includes uncoated supports made of paper, film base, and the like, but also supports that have received already one or more coatings, such as a subbing layer, a first light-sensitive layer, etc.

The term "layer" stands for a single layer as well as for a multiple layer of coating composition. A multiple layer may comprise two, three or more distinct layers that have been formed through separate slots, but that are brought into contact with each other before they leave the coating hopper.

The air shield can be constructed as a solid member curved about an angular portion of the backing roller, this solid air shield having at least one recessed zone forming a chamber. The chamber is the area in which a reduced pressure is maintained. The unrecessed regions of the air shield constitute the means for making the resistance to air flow larger than the resistance in the chamber. The means that form a zone of increased air resistance can also be constructed in other ways. They can be protruding parts, strips or even one or more laminae connected to that shield and extending towards the web. These laminae can extend over the total width of the air shield, or a group of smaller randomly placed laminae can construct a labyrinth. The only function of these obstacles is to form an increased air resistance, as compared with the resistance to air flow in the reduced pressure region of the shield located there between.

The presence of a high resistance is necessary to maintain the required reduced pressure with a low flow rate of evacuated air. Higher flowrates are not desirable since they can cause non-uniformities inside the air shield. Any non-uniformity may cause bandlike disturbances in the coated material.

The pressure difference between the ambient air and the reduced pressure zone of the air shield has to be high enough in order to evacuate the boundary layer of air adhering to the web, but is also limited. When this pressure difference becomes too high, a strong air flow in a direction from the coating curtain towards the airshield might be created. This may cause the entire liquid curtain or at least a part of it to become sucked up into the airshield. This phenomenon destroys the coating procedure and therefore is to be avoided. The required pressure difference depends on the geometry of the arrangement, the distance between the web and the arrangement, the distance between the outlet end of the air shield and the coating curtain and the velocity of the web, and from a practical standpoint is comprised between 10 and 500 Pa.

In order to maintain this reduced pressure it is desirable to provide a means for restricting the inflow of air at the sides of the lateral ends of the shield. Therefore, at the ends too, means are likewise provided that determine zones wherein the resistance to air flow is larger than in a zone located there between. These lateral end means can be constructed in the same way as those forming the inflow end and outflow end of the air shield.

According to a preferred embodiment of the invention, the outlet end of the air shield is placed at a distance between 5 and 30 mm upstream of the line of coating, i.e. the line where the coating curtain first contacts the moving web. Smaller distances involve the risk of a swinging curtain touching and soiling the air shield, whereas larger distances strongly reduce the effect of the air removal. Without the use of reduced pressure zones the rebuilding of a new boundary layer of entrained air takes place at the outlet end of the air shield towards the line of coating. Due to this reduced pressure a small air movement from outside the air shield towards the zones of reduced pressure beneath the shield prevents the establishment of a new boundary layer of air on the web. The new boundary layer cannot rebuild itself immediately after the outlet end of the air shield but starts to form at a point closer to the line of coating. In this way the effect of the air shield is extended to a point which may be up to some mm downstream of the outlet end of that shield.

BRIEF DESCRIPTION OF THE DRAWINGS

The invention is described hereinafter by way of an example with reference to the accompanying drawings, wherein:

FIG. 2 is a cross-sectional view of one embodiment of an air shield configuration, FIG. 3 is a top view of FIG. 2.

DETAILED DESCRIPTION OF THE INVENTION

Figure 1:
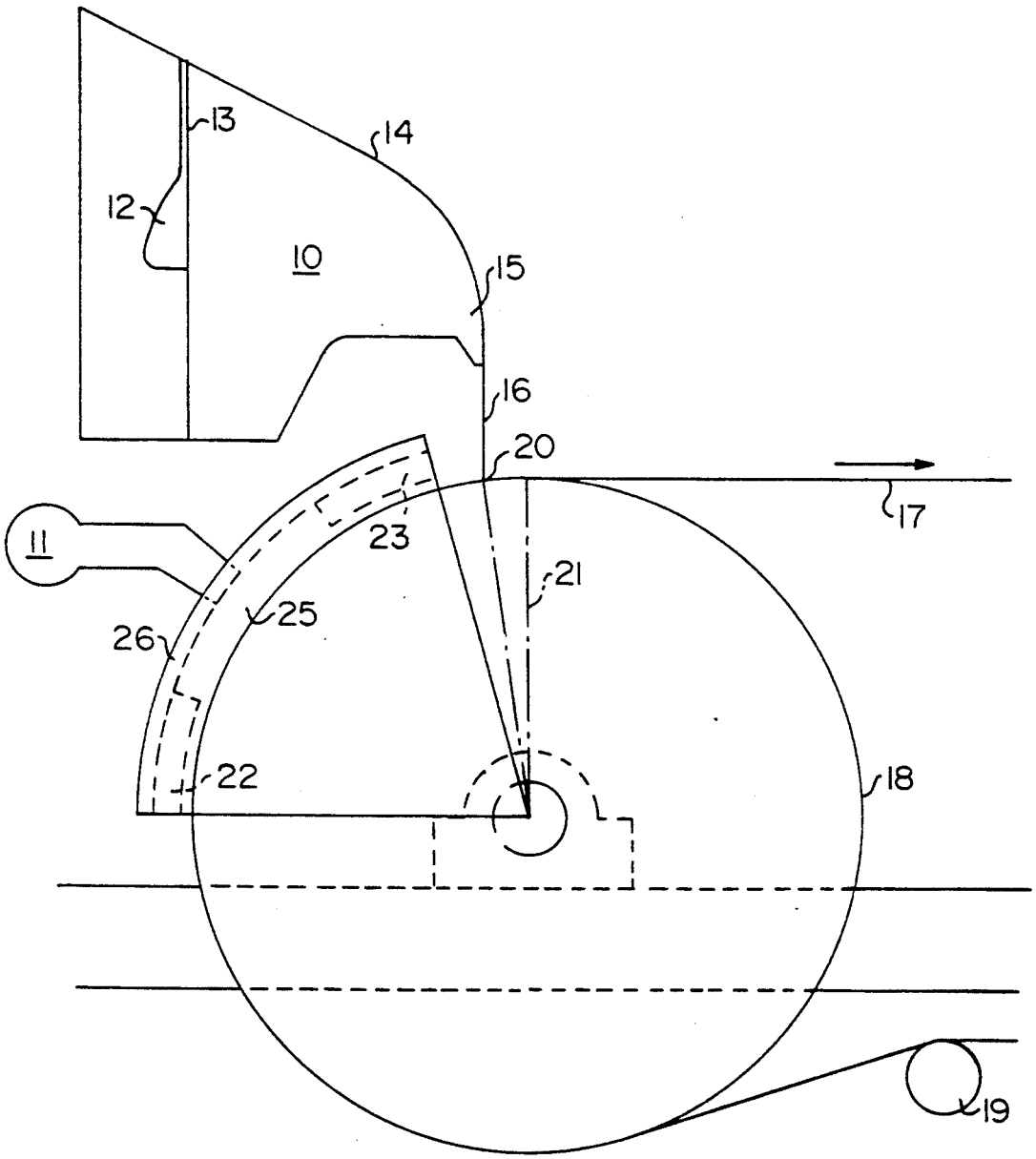
FIG. 1 is a diagrammatic illustration of a curtain coater.

Referring to FIG. 1, a curtain coater is illustrated comprising a coating head 10 of the slide-hopper type that is arranged for applying a layer of liquid coating composition to a moving support by curtain coating. The hopper is supplied with coating composition through a manifold 12 and has an elongated discharge slot 13 from which the coating composition flows over a slide surface 14 onto a lip 15 from which it falls freely downwardly in the form of a curtain 16. The hopper extends transversely of the path of travel of a web 17 to be coated, the path of which is determined by a backing roller 18 to which the web is advanced over a guide roller 19. The falling curtain impinges the web path at a generally fixed locus on the backing roller periphery.

Means is provided, not illustrated, for controlling the correct web speed, the lateral web position, and the web tension.

Edge guides, not illustrated, as known in the art are provided near both lateral ends of lip 15 and are in adherent contact with the edges of the free-falling curtain and thereby keep the curtain stretched in the transverse direction until it contacts the web on a transverse line, illustrated in the figure by point 20.

The coating hopper preferably is mounted for vertical displacement so that the height of the curtain may be adjusted and in consequence the speed of descent of the curtain on the web be set. Further, the coating hopper 10 or roller 18 may be arranged for horizontal displacement so that at the start of a new coating procedure, the coating may be made to fall from the lip directly into a pan (not illustrated) until a bubble-free liquid flow and a satisfactory transverse thickness profile of the curtain have been established. Then the hopper or the roller 18 may be reset to obtain the operative position as shown in the figure. Alternatively, displaceable shield means may be provided between lip 15 and roller 18 in order to temporarily intercept the curtain from contacting web 17, until a stable curtain has been established.

The coater comprises an air shield 26 that is concavely curved concentrically about the axis of roller 18.

FIG. 2 is a cross-sectional view of a preferred embodiment of an air shield configuration. FIG. 3 is a top view of this embodiment, the manifold being removed. The air shield 26, the inlet and outlet arrangements (22,23), and the lateral end arrangements 24 and 31 are constructed as one solid member. The recessed area between these zones of relatively large air resistance forms zone 25 in which a reduced pressure is maintained. This configuration, made for instance of stainless steel, has the major benefit mechanically strong and easy to construct. The zone of reduced pressure 25 is connected through elliptical slots 30 with an air manifold 29 which extends over the full width of the air shield 26. A reduced pressure, stationary in time and place, can easily be maintained by any means 11 such as a suction pump.

The following data illustrate the configuration described in FIGS. 2 and 3. Backing roller 18 has a diameter of 230 mm, and a length of 240 mm. The air shield 25 covers 110 degrees of the backing roller 18. The inflow enlargement means 22 for creating higher air resistance extends over 65 degrees, the recessed area 25 wherein the reduced pressure can be maintained extends over 20 degrees, while the outflow enlargement means 23 covers 25 degrees of the backing roller. The width of the lateral end closure means 24 and 31 is 20 mm. The distance d between the inflow and outflow means 22,23 and backing roller 18 is 1 mm. The fact that both inlet and outlet means are at the same distance from the backing roller is not a limitation but allows its mechanically easy construction. The outlet end of the air shield is placed at a distance e of 10 mm from the contact line 20.

The moisture in the air shield has heating means 28 to avoid condensation of the air between web 17 and air shield 26. Condensation may soil the web or unstabilise the reduced pressure. In any event, condensation endangers the coating procedure. The heating means 28 are electrical in this example, but other means such as water- or steam circuits may be used.

The air velocities at different levels above backing roller 18 identify the boundary layer of air adhering to the web that would disturb the coating curtain. In order to get information about these velocities the following experimental set-up was used: backing roller 18 was driven at a peripheral velocity of 266 m/min. The air velocities at different distances from the peripheral surface of the driven roller have been measured by means of a laser doppler anemometer.

Figure 4A:
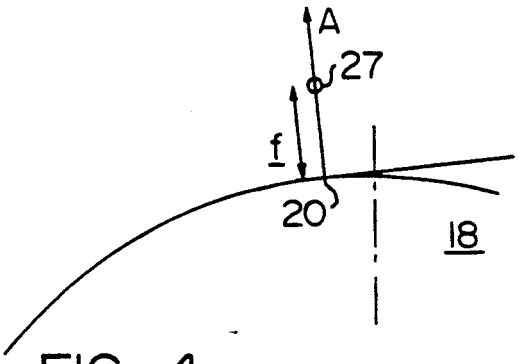
FIG. 4*a* is a diagrammatic illustration of an experimental set-up with no air shield.

The term "measuring point" as will be used hereinafter, is the point of intersection of the two laser beams of the laser anemometer. The air velocities as a function of the distance from a measuring point 27 (see FIG. 4) from the roller surface along an axis A are illustrated in FIG. 5, the curves a, b and c corresponding with the respective arrangements in FIGS. 4*a, b* and *c*. The abcissa represents the measured air velocity in m/min, whereas the ordinate represents the distance between measuring point 27 and roller 18. In FIG. 4*a* the measurements were carried out with no air shield. It may be seen that for a distance f=0, i.e. the measuring point 27 being situated right on the surface of roller 18, the measured velocity perfectly corresponds with the actual roller speed, which may be calculated from the diameter of the roller and its number of revolutions per minute.

The surface area of the diagram included between a curve and the axes of the diagram is important, since it represents the rate of air flow that impinges on the curtain of coating composition, because actually the curtain acts as a shield that is in the way of the air entrained with the moving roller surface (i.e. in practice the web surface). It can be seen that the velocity of the boundary layer of air increases more than proportionately at distances f less than 1 mm, as compared with f larger than 1 mm. Obviously, this rapid acceleration of air entrained closely to the roller surface gives rise to an undesirable disturbance of the vulnerable curtain at the position where the effect is greatest, viz. at the position of impingement on the web.

The measured air velocities remain absolutely constant if the measuring point is displaced in a direction parallel to the roller axis. Thus it could be concluded that the impingement of a uniformly structured air volume on a coating curtain that itself is likewise extremely uniform, only could result in the uniform deflection of the curtain in the direction of the advancing web. However, practice shows that the curtain deflection is not uniform and that instead the curtain is displaced in an undulating way as described already in the introduction of this specification. These wavelike deformations of the curtain cause corresponding thickness variations of a coated layer as has been established experimentally.

Figure 4B:
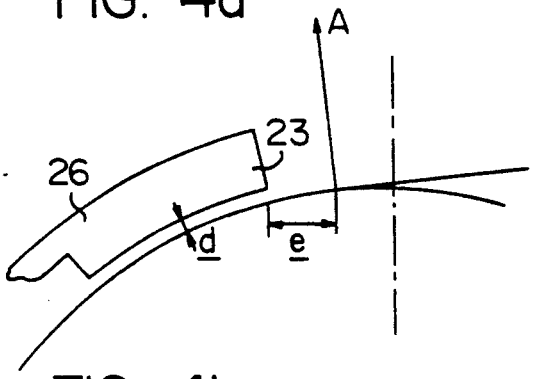
FIG. 4*b* is a diagrammatic illustration of an experimental set-up with an air shield without a reduced pressure area.
Figure 4C:
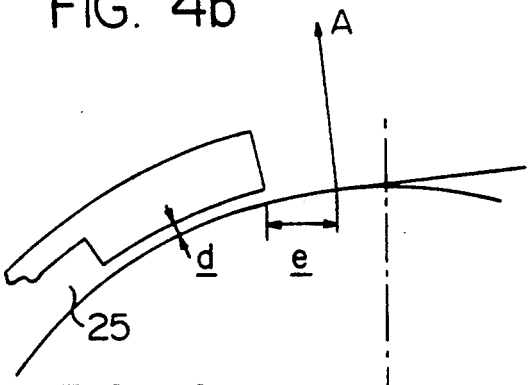
FIG. 4*c* is a diagrammatic illustration of an experimental set-up with an air shield with a reduced pressure area.
Figure 5:
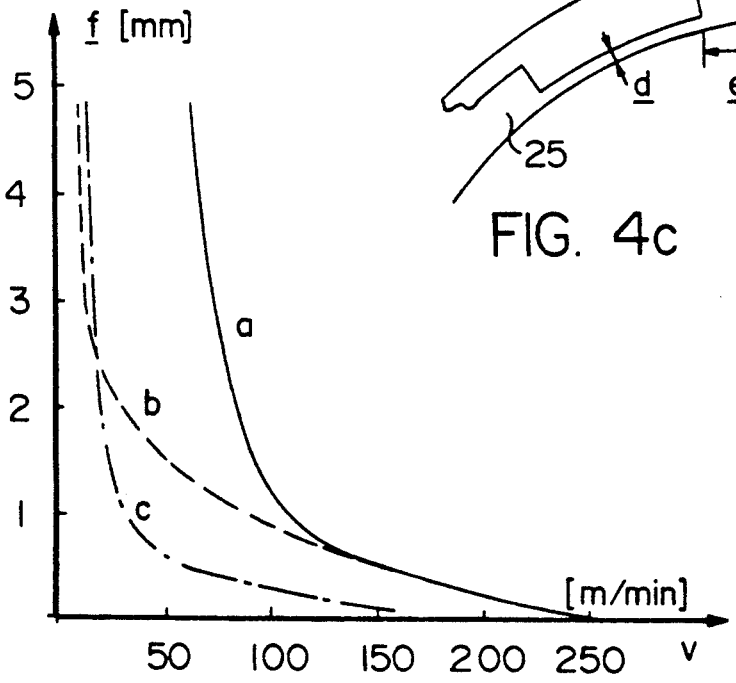
FIG. 5 is a diagram illustrating the results of the arrangements 4*a* to 4*c*.

In FIG. 4*b* the use of an air shield reduces the surface area of the diagram included between curve b and the axes, even when there is no pressure difference. FIG. 4*c* illustrates that a pressure difference (50 Pa in the present example) reduces this area even more. The improvement according to the invention reduces the amount of entrained air by approximately 50%, while the velocity of the entrained air at less than 1 mm near contact line 20 is diminished by a factor larger than 2.

The invention is not limited to the embodiment described hereinbefore. The means that determine the zones of the shield where the resistance to air flow is larger than at the other central zone(s), may take other forms than the one illustrated hereinbefore. They may be protruding parts having a straight, cylindrical, elliptical or other form with a surface faces the backing roller. They may be strips, brushes or even one or more laminae connected to the shield and directed towards the web. These laminae may extend over the total width of the air shield, or a group of smaller laminae randomly placed can construct a labyrinth. More than one zone of reduced pressure can be used. These different zones may be connected with one common air manifold. However, each such zone may also have its own means for reducing the air pressure.

We claim:

1. In a curtain coater for coating a layer of a liquid coating composition on a surface of a continuous moving web in the manufacture of a photographic element, which comprises:

1) a coating hopper for producing a free-falling curtain of said coating composition, 2) a backing roller disposed beneath said coating hopper for contact with one surface of the moving web while guiding the same along an arcuately curved path, whereby said falling curtain impinges on the other surface of the web at a generally fixed locus on the roller periphery to apply a layer of the coating composition to the other web surface, 3) an air shield extending in closely spaced generally parallel relation to the roller periphery around an angular segment thereof directly upstream of the generally fixed locus of said falling curtain to define an arcuate air gap between adjacent surfaces of such shield and the roller periphery through which said web passes prior to reaching said fixed locus, and 4) means connected to said air shield to remove air from said air gap, in combination, the improvement wherein said air shield has at an inlet end region and an outlet end region thereof means for creating a resistance to air flow in the air gap at said end regions which is higher than the resistance to air flow in the gap in a region of said shield intermediate said end regions, the air removing means being in communication with the intermediate region of said air gap.

2. The curtain coating apparatus of claim 1 wherein the means for creating the higher resistance to air flow comprises projections on a side of said air shield facing the roller periphery within said end regions and which extend toward said roller periphery.

3. The curtain coating apparatus of claim 1 wherein said air shield comprises a curved solid plate and the means for increasing the resistance to air flow is constituted by section of said plate adjacent each of said end regions which is of increased thickness than is the plate thickness in the intermediate region thereof whereby the dimension of said gap radially of said roller is reduced in said end regions of the air shield compared to the gap dimension in said intermediate region.

4. The curtain coating apparatus of claim 1 wherein the thickness of said air gap in said regions of reduced thickness is between 0.5 and 2 mm.

5. The curtain coater of claim 1 which further comprises means at opposite side regions of said air shield transversely of said web path for likewise increasing the resistance to air flow in said side regions.

6. The curtain coating apparatus of claim 1 wherein the air removing means is effective to reduce the air pressure within said intermediate region to between 10 and 500 Pa.

7. The curtain coating apparatus of claim 1 including means for heating said air shield.

8. The curtain coating apparatus of claim 1 wherein the separation between the outlet end of said air shield and said coating curtain is between 5 and 30 mm.

9. The curtain coating apparatus of claim 1 wherein the generally fixed locus of said falling curtain is proximate to a vertical plane passing through the axis of said backing roller.

10. The curtain coating apparatus of claim 9 wherein said moving web downstream of said fixed locus moves along a path which is generally tangential to the intersection with said roller periphery of said vertical plane.

* * * * *